United States Patent [19]

Nohira et al.

[11] 4,114,575

[45] Sep. 19, 1978

[54] EXHAUST PRESSURE REGULATING SYSTEM

[75] Inventors: Hidetaka Nohira; Masaaki Tanaka, both of Susono, Japan

[73] Assignee: Toyota Jidosha Kogyo Kabushiki Kaisha, Toyota, Japan

[21] Appl. No.: 627,351

[22] Filed: Oct. 30, 1975

[30] Foreign Application Priority Data

Jul. 1, 1975 [JP] Japan ..... 50-80513

[51] Int. Cl.[2] ..... F02M 25/06

[52] U.S. Cl. ..... 123/119 A; 123/107; 123/97 B; 188/273

[58] Field of Search ..... 123/119 A, 97 B, 107; 188/273

[56] References Cited

U.S. PATENT DOCUMENTS

| | | | |
|---|---|---|---|
| 1,462,945 | 7/1923 | Spiro | 123/103 |
| 3,368,345 | 2/1968 | Walker | 123/97 B |
| 3,577,727 | 5/1971 | Warren | 123/97 B |
| 3,713,428 | 1/1973 | Sandhagen | 123/119 A |
| 3,779,222 | 12/1973 | Lorenz | 123/119 A |
| 3,800,765 | 4/1974 | Thompson | 123/119 A |
| 3,802,402 | 4/1974 | Swatman | 123/119 A |
| 3,834,366 | 9/1974 | Kingsbury | 123/119 A |
| 3,838,670 | 10/1974 | King | 123/97 B |
| 3,878,823 | 4/1975 | Vartanian | 123/119 A |
| 3,880,129 | 4/1975 | Hollis | 123/119 A |
| 3,885,538 | 5/1975 | Suter | 123/119 A |
| 3,888,143 | 6/1975 | Kolehmainen | 123/119 A |
| 3,915,136 | 10/1975 | Caldwell | 123/119 A |
| 3,926,161 | 12/1975 | Wertheimer | 123/119 A |

*Primary Examiner*—Charles J. Myhre
*Assistant Examiner*—Jeffrey L. Yates
*Attorney, Agent, or Firm*—Finnegan, Henderson, Farabow & Garrett

[57] ABSTRACT

An exhaust pressure regulating system for use with an exhaust gas recirculating system of an internal combustion engine, and particularly for an automobile, utilizing a control valve of the butterfly or poppet type in the exhaust pipe for adjusting the back pressure in the exhaust, a vacuum-sensitive device for actuating the control valve, a pressure-signal passage for applying the pressure in the intake manifold to the vacuum-sensitive device and a pressure-comparing valve sensitive to the quantity of air being taken into the engine and the adjusted back pressure in the exhaust for modulating the pressure in the pressure-signal passage. The pressure-comparing valve includes a pair of interlocked diaphragms actuated in opposed relationship interacting with a biased valve member in the pressure-signal passage, one of the interlocked diaphragms being actuated by the venturi vacuum pressure created by the quantity of air being taken into the engine through the carburetor and the other of the diaphragms being actuated by the adjusted back pressure and tending to open the valve and bleed-off pressure in the pressure-signal passage. A booster valve is preferably used to amplify the venturi vacuum pressure and a pressure-changeover valve, sensitive to operating conditions of the engine, may be disposed in the pressure-signal passage.

14 Claims, 7 Drawing Figures

EXHAUST PRESSURE REGULATING SYSTEM

BACKGROUND OF THE INVENTION

1. Field of the Invention

The present invention relates to an exhaust pressure regulating system for use with an exhaust gas recirculation system of an automobile.

2. Description of the Prior Art

An exhaust gas recirculation system (which will be hereafter referred to as "EGR" system) extracts exhaust gases from a portion of the exhaust system of an automobile and reintroduces the extracted gases into the intake system. The flow rate of the exhaust gases to be recirculated is conventionally dependent upon the gas pressure differential between the points of extraction and reintroduction of the exhaust gases.

Especially in an EGR system of the exhaust pressure control type, the quantity of exhaust gas recirculated is greatly influenced by the pressure level at the point of extraction. Since, on the other hand, the pressure at the extraction point varies not only with the diameter and shape of the engine exhaust pipe but also the variations in dimensions in the mass production of the exhaust pipe and the muffler, the quantity of exhaust gas recirculated becomes different among the automotive vehicles of the same type, thus inviting one of the major causes for the variation in the exhaust emission. Moreover, even if the automotive vehicle is equipped with the EGR system of exhaust pressure control type, the quantity of exhaust gas recirculated is reduced to a low level, during the low speed mode of operation of the engine at a low speed and a light load, due to reduction in the exhaust gas pressure. For this low speed mode or for light load operation of the engine, the EGR system will not begin to function easily, thus inviting difficulties in the exhaust gas emission control.

SUMMARY OF THE INVENTION

It is, therefore, a primary object of this invention to improve control of the quantity of exhaust gas recirculated in the EGR system of an automobile.

It is also an object of the present invention to provide an exhaust pressure regulating system which can ensure stabilization of the exhaust emission control by eliminating the effect of variations in dimensions in the mass production of exhaust pipe and mufflers with respect to the pressure at the extraction point of the EGR system.

Another object of the present invention is to provide an exhaust pressure regulating system which contemplates the increase of the exhaust pressure with a view partly to increasing the quantity of exhaust gas recirculated and partly to widening the span of time during which the exhaust gas is recirculated so as to make the exhaust gas emission control more stable.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the exhaust pressure regulating system of this invention comprises valve means for adjusting the back pressure in the exhaust and means sensitive both to the quantity of air being taken in to the engine and to the back pressure in the exhaust for controlling the back-pressure adjusting valve means.

Preferably, the sensitive means comprises a pressure-comparing valve, including first and second interconnected diaphragms, the first diaphragm being actuated by the quantity of air being taken into the engine and the second diaphragm being actuated by the back pressure in the exhaust, the actuation of the diaphragms being in opposed relationship.

In the preferred embodiment, the valve means for adjusting the back pressure is pressure-sensitive and the sensitive means also includes conduit means for applying the vacuum pressure in the intake manifold of the exhaust system to the back-pressure adjusting valve means, the pressure-comparing valve including means for modulating the gas pressure in the applying means, the inter-connected diaphragms controlling the modulating means. The modulating means is preferably a bleeder valve and the diaphrams may be locked together in a 1:1 ratio.

It is preferred that the valve means for adjusting the back pressure include a vacuum-sensitive device having a link-connection to a butterfly valve or a poppet valve in the exhaust pipe.

Preferably, the first diaphragm of the pressure-comparing valve is vacuum-actuated, the pressure of the vacuum being determined by the gas flow in a venturi action across the end of a conduit opening in the throat of the air inlet to the air-fuel mixture chamber of the fuel supply system and the intake manifold of the engine. A vacuum-pressure boosting valve preferably is incorporated in the conduit between the venturi vacuum and the pressure-comparing valve, the boosting valve utilizing the pressure in the intake manifold for activation of the boosting valve.

A pressure-changeover valve is utilized in the preferred embodiment in the conduit means between the intake manifold and the pressure-comparing valve, the pressure-changeover valve being responsive to the driving conditions of the vehicle and the operating conditions of the engine.

The invention consists in the novel parts, constructions, arrangements, combinations and improvements shown and described. The accompanying drawings, which are incorporated in and constitute a part of this specification, illustrate one embodiment of the invention and, together with the description, serve to explain the principles of the invention.

DESCRIPTION OF THE PREFERRED EMBODIMENTS

Reference will now be made in detail to the present preferred embodiment of the invention, an example of which is illustrated in accompanying drawings.

Figure 1:
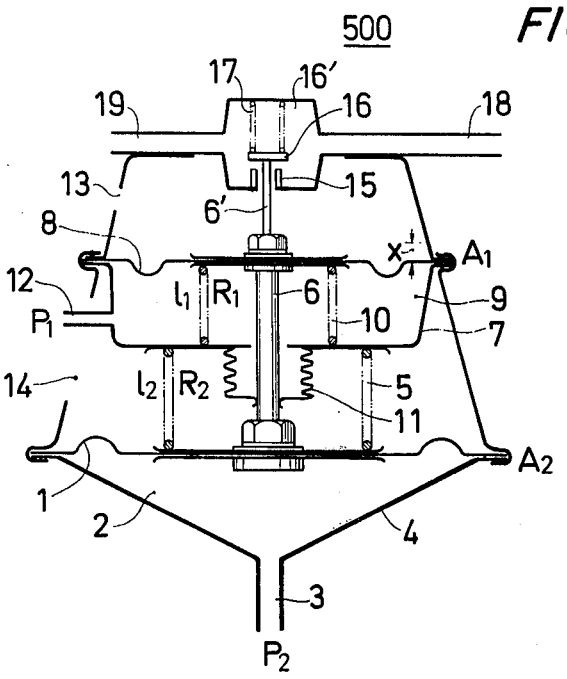
FIG. 1 is a diagrammatical section showing a pressure-comparing control valve to be incorporated into an exhaust pressure regulating system according to the present invention.
Figure 2:
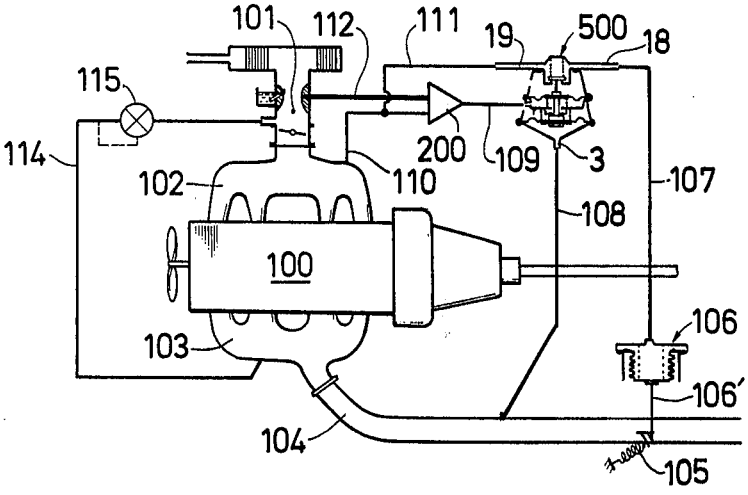
FIG. 2 is a diagrammatical view showing an engine block equipped with the exhaust pressure regulating system of the present invention.

Referring now to FIGS. 1 and 2, it may be seen that the exhaust pressure regulating system of the invention is incorporated in an automotive engine having an engine block 100, a carburetor 101, an intake manifold 102 leading to the engine block and an exhaust manifold 103 flowing into an exhaust pipe 104.

An exhaust gas recirculation (EGR) system includes an exhaust gas recirculation pipe 114 connecting the exhaust manifold 103 with the carburetor 101, the pipe 114 having therein an EGR control valve 115, as known in the art.

In accordance with the invention, the exhaust pressure regulating system includes means for adjusting back pressure in the exhaust system of the automobile and a pressure-comparing valve for controlling the back pressure adjusting valve means.

As herein embodied, the means for adjusting the exhaust back pressure includes a back-pressure control valve 105 in the exhaust pipe 104 actuated by a vacuum-sensitive device, such as drive mechanism 106, or diaphragm valve 300, (FIGS. 3 and 4) through a link 106'. The back-pressure control valve 105 may be, e.g., a butterfly valve or a poppet valve, as will be hereinafter set forth in more detail with respect to FIGS. 3 and 4.

The pressure-comparing valve, as embodied herein, numbered generally as 500, interconnects and controls a signal vacuum passage including vacuum conduits 111 and 110 leading to the intake manifold 102 and vacuum conduit 107 leading to drive mechanism 106 of the exhaust back-pressure adjusting means. The signal vacuum passage, therefore, applies the normally vacuum pressure in the intake manifold to the back pressure adjusting valve 105 through the pressure-comparing valve 500.

The pressure-comparing valve 500, as depicted in FIG. 2, includes as its major constituents, a first diaphragm chamber 9, including a first diaphragm 8, and a second diaphragm chamber 2, including a second diaphragm 1. The first diaphragm 8 and second diaphragm 1 are linked together by a shaft 6, preferably in a 1:1 relationship so that their displacements are the same.

The shaft 6, linking the diaphragms 8 and 1, actuates a valve member 16 against the bias of a spring 17, by means of an extension 6' of the shaft 6 which abuts against the bleeder-valve member 16. The valve member 16 is located in a valve chamber 16' which is open through a sensing pipe 19 to the intake manifold 102 through conduits 111 and 110 and through a sensing pipe 18 to the back pressure control valve 105 through conduit 107, drive mechanism 106 (or diaphragm valve 300) and link 106'.

Therefore, when the interlocked first diaphragm 8 and second diaphragm 1 lift the bleeder valve member 16 off its valve seat 15 against the bias of the spring 17, a bleeder opening is provided for modulating the pressure acting on the vacuum-sensitive device 106 for adjusting the back pressure in the exhaust pipe 104 by means of the valve 105.

The first diaphragm chamber 9 is formed between the first diaphragm 8 and a portion of a casing 7. A vacuum-sensing pipe 12 is formed in the wall of the casing 7 leading to the first diaphragm chamber 9. An orifice forming the valve seat 15 and an air vent 13 are formed in the wall of the casing 7 outside the diaphragm chamber 9. A spring 10 concentric with the shaft 6 acts against the casing 7 to bias the diaphragm 8 toward the valve member 16.

The second diaphragm chamber 2 is formed between the second diaphragm 1 and a portion of a casing 4 joined to the casing 7. An air vent 14 is formed in the casing 4 between the second diaphragm chamber 1 and the point of joining the casing 4 with the casing 7. The shaft 6, passing through an opening in the casing 7 is interconnected to the casing 7 by a bellows 11 to permit reciprocation of the shaft 6 through the casing 7 while preventing fluid intercommunication between the first diaphragm chamber 9 and the air vent 14. A spring 5 also concentric with the shaft 6 acts against the outer surface of the casing 7 to bias the diaphragm 1 away from the valve member 16.

A back-pressure sensing pipe 3 is positioned in the wall of the casing 4 in the second diaphragm chamber 2, i.e., on the other side of the diaphragm 1 from the air vent 14.

The pressure-comparing control valve 500, as embodied herein is incorporated into the system of an engine such as shown in FIG. 2 and has its back-pressure sensing pipe 3 communicating with the exhaust pipe 104 through back-pressure conduit 108, a sensing pipe 18 communicating with the back-pressure control valve 105 in the exhaust pipe 104 by way of the pressure conduit 107 and the vacuum-sensitive device 106, another sensing pipe 19 communicating with the intake manifold 102 through vacuum conduits 111 and 110 and the sensing pipe 12 leading through a pressure conduit 109 to the carburetor 101 by way of a venturi vacuum conduit 112.

The pressure-comparing valve 500 as embodied herein, is therefore sensitive to the air intake to the engine through the carburetor 101 acting through the vacuum sensing pipe 12 on the first diaphragm 8 and to the exhaust back pressure in exhaust pipe 104 acting through the back-pressure sensing pipe 3 on the second diaphragm 1 for controlling the bleeder valve 16 in the pressure conduits between the intake manifold 102 and the back pressure control means comprising the drive mechanism 106 (or diaphragm valve 300), the link 106' and the back-pressure control valve 105.

In the preferred embodiment a vacuum pressure-boosting valve, numbered generally 200, is inserted between the pressure-comparing valve and the carburetor 101.

Figure 5:
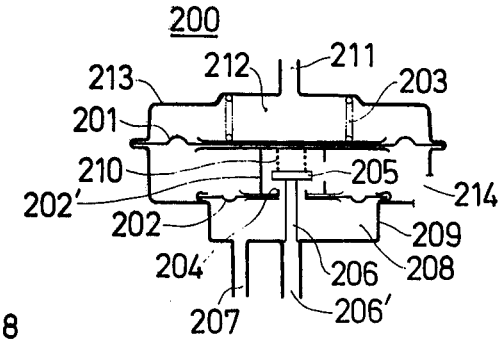
FIG. 5 is a diagrammatical section showing a venturi vacuum-boosting valve utilizable in the system of FIG. 2.

As herein embodied, the vacuum-pressure boosting valve 200, as depicted in FIG. 5, includes an inlet pipe 207, communicating with the venturi vacuum of the carburetor 101 through the pressure conduit 112 and a boosted pressure pipe outlet 211 communicating with the vacuum-sensing pipe 12 of the pressure-comparing valve 500 through conduit 109.

The vacuum-pressure boosting valve 200 includes, as its major constituents, two diaphragms 201, 202 being substantially parallel and joining the sides of a casing 213 of the valve 200 between the inlet pipe 207 and the boosted pressure pipe 211. Diaphragm 202 joins the sides of a portion 209 of the casing 213 to form a venturi vacuum chamber 208 having access to the venturi vacuum through the inlet pipe 207 and conduit 112.

Diaphragm 201 forms a boosted pressure chamber 212 with the casing 213, the chamber 212 having access only to the boosted vacuum pressure pipe 211, and thereby to the vacuum-sensing pipe and diaphragm chamber 9 of the valve 200 through conduit 109. The area between the two diaphragms 201, 202 includes an air vent 214 in the casing 213. The two diaphragms 201, 202 are interconnected by a member 202' for unitary action, provision being made in the member 202' for access to the air vent 214.

The volume of the venturi vacuum chamber 209 and the area of the diaphragm 202 are substantially smaller than the volume of the boosted vacuum chamber 211 and the area of the diaphragm 201.

An orifice 204 is formed in the diaphragm 202 communicating between the venturi vacuum chamber 208 and the air vent 214. The orifice 204 is formed as a valve seat for an activating valve member 205 biased toward the orifice 204 in the diaphragm 202 by a spring 210 located between the valve member 205 and the diaphragm 201.

A nozzle 206 is mounted on the base of the valve member 205 and extends through the orifice 204 and the venturi vacuum chamber 208 into a pipe 206' formed in the wall portion 209 of the casing 213. The pipe 206' communicates with the intake manifold 102 through the vacuum conduit 110 and the nozzle 206 is slidably mounted in the pipe 206'. Therefore, when the vacuum in the intake manifold 102 overcomes the bias of the spring 210 and activating valve member 205 closes the orifice 204, the venturi vacuum in the chamber 208 acts on both the diaphragms 201, 202 in the pressure boosting valve 200. Since the area of diaphragm 201 is substantially larger than the area of the diaphragm 202 and the displacement is the same, the volume of gas displaced in the boosted pressure chamber 212 will be an amplified function of the venturi vacuum applied to the diaphragm 202.

The vacuum acting on the diaphragm 8 of the pressure-comparing valve 500 will, therefore, be a function of the quantity of air entering the engine, as reflected by the venturi vacuum in the conduit 112.

Figure 3:
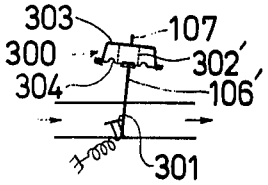
FIGS. 3 and 4 are explanatory views showing butterfly and poppet valves respectively, of the diaphragm-driven type.
Figure 4:
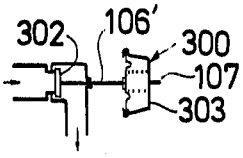

As illustrated in FIGS. 3 and 4, a diaphragm valve 300 may be substituted for the drive mechanism 106 for actuating the link 106' and the back pressure adjusting valve 105. The back pressure adjusting valve 105 in turn may be a butterfly valve as shown in FIG. 3, or a poppet valve as shown in FIG. 4.

The diaphragm valve 300 is comprised of an immobile cup 303 having a diaphragm 304 across its open end, the diaphragm 304 being joined to the link 106'. The area within the cup 303 has access only to the pressure conduit 107 and the diaphragm 304 is biased outwardly by a spring 305.

Figure 6:
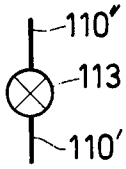
FIG. 6 is a schematic representation of a pressure-changeover valve for use in line 110 of FIG. 2.

As schematically shown in FIG. 6, and as embodied herein, a pressure-changeover valve 113 may be inserted in the vacuum conduit 110, dividing the conduit into portions 110' and 110''. Pressure-changeover valve 113 may be made responsive, e.g., to the temperature of the engine and the drive conditions of the vehicle, such as vehicle speed or gear position, so as to increase or decrease the quantity of exhaust gas recirculated through the magnitude of the exhaust pressure, as hereinafter explained.

In the normal operating conditions of the engine at substantially constant speed, the gas pressure in the intake manifold 102 is negative with respective atmospheric pressure, tending to apply a vacuum pressure through the signal-vacuum passage including the vacuum-pressure conduits 110, 111, valve 500 and vacuum conduit 107 to the drive mechanism 106 (or diaphragm valve 300) tending to open the pressure adjusting valve 105 against bias. If the vacuum pressure in the intake manifold 102 is reduced with respect to atmosphere for any reason, the bias on the valve 105 tends to close the valve and increase the back pressure in the exhaust.

Meantime the pressure in the signal-vacuum passage is modulated by the bleed-off valve member 16 of the pressure-comparing valve 500 as a function of the air being taken into the engine, as reflected by the venturi vacuum, or its amplified pressure, acting on the diaphragm 8, as compared with the exhaust back pressure acting on the diaphragm 1.

Now, the operations of the pressure comparing control valve 500 having the above construction to be incorporated into the system of the present invention will be explained. If it is assumed that the effective areas of the first diaphragm 8 and second diaphragm 1 are $A_1$ and $A_2$, respectively, that the spring constants of the springs 10 and 5 are $R_1$ and $R_2$, respectively, that the deflections of the springs 10 and 5 from their free lengths during assembly of the control valve 500 are $l_1$ and $l_2$, respectively, that the pressures in the first and second diaphragm chambers 9 and 2 are $p_1$ and $p_2$, respectively, and that the displacement of the two diaphragms is $x$, the following equations are obtainable from consideration of the balance in forces:

Downward Force $F_1 = p_1 \cdot A_1 + R_2(l_2 - x)$

Upward Force $F_2 = p_2 \cdot A_2 + R_1(l_1 - x)$

Since $F_1 = F_2$ and $x = 0$ at the balance point, the following equation holds:

$$p_2 = \frac{A_1}{A_2} p_1 + \frac{1}{A_2} (R_2 \cdot l_2 - R_1 \cdot l_1) \quad (1)$$

If the following relationship is present here:

$$R_2 \cdot l_2 \simeq R_1 \cdot l_1 \quad (1')$$

Then the following relationship is obtained:

$$p_2 = (A_1/A_2)\, p_1 \quad (2)$$

If, moreover, it is assumed that $p_1$ be a boosted or amplified venturi vacuum (with an amplification of $\alpha$) since it is a pressure representative of the quantity of the intake air, $$p_1 = \alpha \cdot p_v \text{ (}p_v\text{: the venturi vacuum)} \quad (3)$$

From the equations (2) and (3), the following equation is obtained:

$$p_2 = A_1 \cdot \alpha / A_2 \cdot p_v$$

If, here, it is assumed that $A_1 = A_2$ as to the effective areas $A_1$ and $A_2$ of the first and second diaphragms of the pressure-comparing control valve, $$p_2 = \alpha \cdot p_v \quad (4)$$

On the other hand, since $\alpha = 1$ for the case where the venturi vacuum is not boosted, $$p_2 = A_1/A_2 - p_v \quad (5)$$

From this relationship (5), the relationship of $p_2 = \alpha \cdot P_v$ can be obtained if it is preset that the value $A_1/A_2$ be $\alpha$. If, therefore, the ratio of the effective areas of the two diaphragms is preset at such suitable value, the same operation can be obtained with use of the pressure-comparing control valve 500 only, without resorting the pressure-boosting valve 200.

Figure 7:
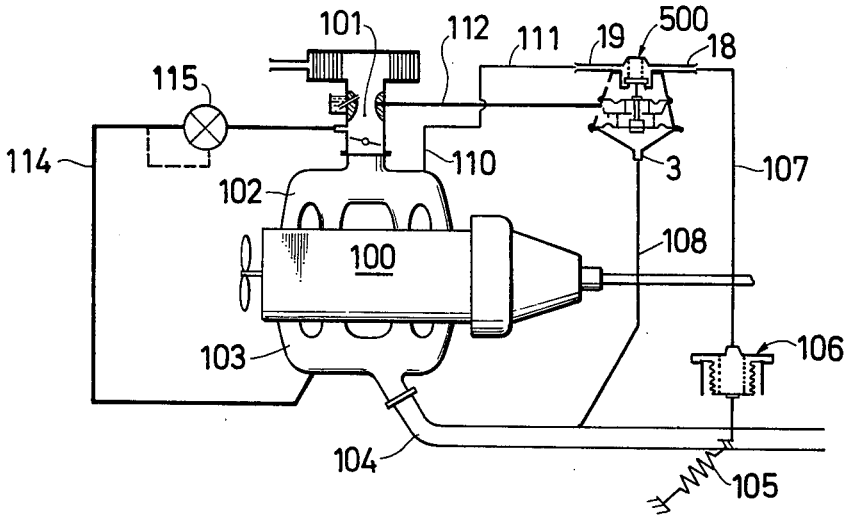
FIG. 7 is a diagrammatical view showing an engine block equipped with an alternative embodiment of the exhaust pressure regulation system of the present invention.

As embodied herein, and shown in FIG. 7, the pressure boosting valve 200 can be eliminated. In this alternative embodiment, the venturi vacuum conduit 112 directly connects the venturi passage in the carburetor 101 with the vacuum-sensing pipe 12 of the pressure-comparing valve 500.

The exhaust pressure regulating system of the invention, as embodied herein, therefore, tends to stabilize the exhaust pressure regardless of variations in the sizes of the exhaust pipe and muffler due to mass production and to increase the exhaust pressure with a view to increasing the quantity of exhaust gas recirculated and to widening the time span of coverage of the EGR system so as to make the exhaust gas emission control more stable.

It will be apparent to those skilled in the art that various modifications and variations could be made in the exhaust pressure regulating system of the invention without departing from the scope or spirit of the invention.

What is claimed is:

1. An exhaust pressure regulating system in combination with an internal combustion engine having a carburetor in which a venturi vacuum pressure is created by air taken into the engine therethrough, an intake manifold and an exhaust comprising:

pressure-sensitive valve means including an exhaust valve in the exhaust for directly adjusting the back pressure in the exhaust;

a pressure-signal passage for applying the vacuum pressure in the intake manifold directly to said pressure-sensitive valve means;

a pressure-comparing valve including first and second interlocked diaphragms for modulating the vacuum pressure in said pressure-signal passage;

means for applying the venturi vacuum pressure created by the quantity of air taken into the engine through the carburetor to said first diaphragm;

means for applying the adjusted back pressure in the exhaust to said second diaphragm; and wherein said pressure-comparing valve includes a valve member in said pressure-signal passage for bleeding off pressure therein, said valve member tending to be opened by pressure against said second diaphragm in opposition to the vacuum pressure applied to said first diaphragm.

2. The exhaust pressure regulating system of claim 1 also including means for amplifying the venturi vacuum pressure applied to said first diaphragm.

3. The exhaust pressure regulating system of claim 2 wherein said venturi vacuum pressure amplifying means includes a pressure-boosting valve comprising two interlocked diaphragms, one of said diaphragms being substantially larger than the other and wherein the smaller of said diaphragms is actuated by said venturi vacuum pressure and wherein said exhaust pressure regulating system includes means for forming a closed system between the larger of said diaphragms of said pressure boosting valve and said first diaphragm of said pressure-comparing control valve.

4. The exhaust pressure regulating system of claim 3 wherein said pressure-boosting valve also includes an activating valve in said smaller diaphragm, and wherein said vacuum pressure amplifying means also includes means for applying the vacuum pressure in said intake manifold to said activating valve for closing said activating valve against bias.

5. The exhaust pressure regulating system of claim 1 wherein said pressure-sensitive valve means includes a vacuum-sensitive device and a link between said vacuum-sensitive device and said exhaust valve.

6. The exhaust pressure regulating system of claim 5 wherein said vacuum-sensitive device is a diaphragm valve.

7. The exhaust pressure regulating system of claim 5 wherein said exhaust valve is a butterfly valve.

8. The exhaust pressure regulating system of claim 5 wherein said exhaust valve is a poppet valve.

9. The exhaust pressure regulating system of claim 5 also including a pressure-changeover valve in said pressure-signal passage said pressure-changeover valve being responsive to engine operating conditions.

10. The exhaust pressure regulating system of claim 1 for use with an internal combustion engine having a system for recirculating exhaust gas from a take-out port in the exhaust through the carburetor to the intake manifold of the engine wherein said exhaust valve is located in the exhaust downstream of the recirculating exhaust gas take-out port and said pressure-comparing valve is independent of the system for recirculating exhaust gas.

11. The exhaust pressure regulating system of claim 10 also including means for amplifying the venturi vacuum pressure applied to said first diaphragm.

12. The exhaust pressure-regulating system of claim 10 wherein said valve means also includes vacuum-sensitive means for driving said exhaust valve.

13. The exhaust pressure-regulating system of claim 12 wherein said exhaust valve is a butterfly valve.

14. The exhaust pressure-regulating system of claim 12 wherein said exhaust valve is a poppet valve.

* * * * *